US008001759B2

(12) United States Patent
Wassenhoven et al.

(10) Patent No.: US 8,001,759 B2
(45) Date of Patent: Aug. 23, 2011

(54) METHOD FOR OPERATING A TEXTILE MACHINE

(75) Inventors: Heinz-Georg Wassenhoven, Mönchengladbach (DE); Hans Grecksch, Mönchengladbach (DE)

(73) Assignee: Oerlikon Textile GmbH & Co. KG, Monchengladbach (DE)

( * ) Notice: Subject to any disclaimer, the term of this patent is extended or adjusted under 35 U.S.C. 154(b) by 398 days.

(21) Appl. No.: 11/992,922

(22) PCT Filed: Jul. 14, 2006

(86) PCT No.: PCT/EP2006/006892

§ 371 (c)(1),
(2), (4) Date: Feb. 19, 2009

(87) PCT Pub. No.: WO2007/045289

PCT Pub. Date: Apr. 26, 2007

(65) Prior Publication Data

US 2009/0223199 A1 Sep. 10, 2009

(30) Foreign Application Priority Data

Oct. 15, 2005 (DE) ..... 10 2005 049 436

(51) Int. Cl.
*D01H 13/32* (2006.01)

(52) U.S. Cl. ..... 57/264; 57/265

(58) Field of Classification Search ..... 57/264, 57/265; 700/139, 144
See application file for complete search history.

(56) References Cited

U.S. PATENT DOCUMENTS

| | | | | |
|---|---|---|---|---|
| 6,009,700 | A | 1/2000 | Wassenhoven et al. | 57/263 |
| 6,886,321 | B2 * | 5/2005 | Sonntag et al. | 57/404 |
| 7,041,980 | B2 * | 5/2006 | Schuller et al. | 250/361 R |
| 2003/0070414 | A1 | 4/2003 | Pohn et al. | 57/404 |
| 2003/0221406 | A1 * | 12/2003 | Sonntag et al. | 57/404 |

FOREIGN PATENT DOCUMENTS

| | | | |
|---|---|---|---|
| DE | 37 32 367 | A1 | 11/1988 |
| DE | 197 55 060 | A1 | 6/1999 |
| DE | 101 17 095 | A1 | 10/2002 |
| EP | 0 922 797 | A2 | 6/1999 |

* cited by examiner

*Primary Examiner* — Shaun R Hurley
(74) *Attorney, Agent, or Firm* — K&L Gates LLP

(57) ABSTRACT

An improved method for operating a textile machine having plural workstations comprising exchangeable components, each having a readable and writable transponder arranged on or integrated in the exchangeable components. During the lifecycle of the exchangeable components at least the operating data which influence the wearing of the exchangeable components are automatically stored on the respective transponder. Textile machines for carrying out the method are characterised by arranging in the region of each workstation at least one transceiver for writing and reading the transponders attached to or integrated in the exchangeable components.

18 Claims, 5 Drawing Sheets

METHOD FOR OPERATING A TEXTILE MACHINE

CROSS-REFERENCES TO RELATED APPLICATIONS

This application claims the benefit of German patent application 10 2005 049 436.6, filed Oct. 15, 2005, herein incorporated by reference.

FIELD OF THE INVENTION

The present invention relates to a method for operating a textile machine having a plurality of workstations, and more particularly to such a method wherein the workstations comprise exchangeable components, each having a readable and writable transponder arranged on the exchangeable components or integrated therein. The present invention further relates to a textile machine for carrying out the referenced method, and more particularly to such a textile machine comprising a plurality of workstations, each case having one or more exchangeable components with a readable and writable transponder.

BACKGROUND OF THE INVENTION

A method for preparing a subsequent treating or processing operation of a textile bobbin is known from German Patent Publication DE OS 37 32 367 wherein a readable and writable electronic memory chip is arranged on the textile bobbin or the tube thereof. The memory chip is used to store specific information for the respective textile bobbin produced on a textile machine, such as the production date, the production time, the production site, the machine number, the batch number, the fiber material, the yarn length and the like. However, information about the number of completed clearer cuts or the number of yarn breaks eliminated which occurred during production of the textile bobbin and which are relevant to the subsequent treating or processing operations, is also recorded.

A method for operating an open-end spinning mechanism is known from German Patent Publication DE 197 55 060 A1, in which an identification marking which is configured as a transponder or as a barcode, is arranged on a spinning rotor. The transponder and also the barcode are used as information carriers of product data specific to the spinning rotor, such as the year of construction, type, size or the like. This readable information is used to avoid faulty use of a spinning rotor type when installing the spinning rotor in a workstation of an open-end spinning mechanism. This serves to ensure that the correct spinning rotors in terms of spinning technology are always used for the respective yarn batch. The transponder used is provided with a permanently stored coding which only allows the specification of the spinning rotor.

The method proposed according to German Patent Publication DE 197 55 060 A1 only provides for the identification of the spinning rotor used against the background of safety and production aspects.

It is known from German Patent Publication DE 101 17 095 A1 to provide exchangeable machine components of a textile machine with an identification marking. The identification markings are configured as colour markings which are read out by means of an optical recording system. The information read out allows conclusions in the manner already mentioned about the nature and the type of exchangeable component. In this manner, the sensible use of components on the textile machine is to be ensured in terms of spinning technology, as already known from German Patent Publication DE 197 55 060 A1. German Patent Publication DE 101 17 095 A1 also only discloses the possibility of identification of an exchangeable component against the background of safety and production aspects.

SUMMARY OF THE INVENTION

The present invention is therefore based on the object of providing a method and a textile machine for carrying out the method, whereby the automatic recording of data influencing the wear of an exchangeable component is made possible.

This object is achieved by providing an improved method for operating a textile machine having a plurality of workstations, wherein the workstations comprise exchangeable components, which in each case have a readable and writable transponder which is arranged on the exchangeable components or integrated therein. According to the method of the present invention, during the lifecycle of the exchangeable components at least the operating data which influence the state of wear of the exchangeable components and can be recorded for these during the period of use thereof are automatically stored on the respective transponder. The present invention further provides an improvement in textile machines for carrying out the present method, characterised in that at least one transceiver for writing and reading the transponders attached to the exchangeable components or integrated therein is arranged in the region of each workstation.

Further advantageous configurations, features and advantages of preferred embodiments of the method and textile machine of the present invention are described more fully hereinafter.

According to the present invention, it is proposed that during the lifecycle of the exchangeable components, at least the operating data which directly influence the state of wear of the exchangeable components and can be recorded for these during the period of use thereof are stored on the transponder. The operating data to be recorded are, for example, data such as the tonnage processed with the respective components, optionally broken down over a plurality of batches and the number of operating hours during which the components were used. Likewise, the conditions of use under which the exchangeable components were used may be recorded, such as, for example, the rotational speed during the processing of a batch, the average rotational speed over the period of use or the total period of use of the components. However, the number of yarn breaks or the clearing cuts in relation to the period of use of the components may also be recorded in the respective transponder.

The operating data recorded over the lifespan allow assessment of the degree of wear-dependent behaviour of the exchangeable components under different conditions of use. In this manner, quality profiles can be set up for the respective components and this allows optimisation of the exchangeable components in relation to their conditions of use. This may lead to improved utilisation of the service lives, components of the same type with a similar state of wear being used to process a batch.

For this purpose, when components are exchanged, the quality of the component used for the exchange can rapidly be checked and compared using operating data and consequently a more reliable statement can be made about the usability thereof. Moreover, a categorisation of the components as a function of wear is made possible so the stock keeping becomes more transparent. Possible categories are above all the actual period of use of the components or the throughput achieved.

In addition, on the basis of knowledge of the wear of the stored components, it can be weighed up whether and to what extent the relevant components are used again or what quality can be achieved through the processing of a batch on the basis of the use of the components on a textile machine.

Above all, the operating data of the exchangeable components directly connected with the material to be processed, such as the fiber band (commonly referred to as a sliver) or the yarn to be produced, are to be recorded. According to the invention, the method is used in various textile machines, such as rotor spinning machines, ring spinning machines, winding machines, twisting machines or the like, in which the exchangeable components, in particular, are provided with transponders, which directly come into contact with the material to be processed and are therefore subject to greater wear than, for example, other exchangeable components of the textile machine.

A further substantial advantage is produced in that the operating data recorded in the transponder are not deleted when the exchangeable components are removed from the textile machine. The operating data recorded in the transponders are also available for a repeated use of the exchangeable components as the operating data were stored individually in the transponder associated with the respective component and not at a central location of the textile machine. In this manner, the necessary storage requirement at the textile machine is reduced. In addition, the textile machines do not have to be connected to one another in such a way for this that they can exchange operating data with one another to ensure that when using the component on a different textile machine of the same type, the history of the lifecycle of the exchanged component is available. Rather, the operating data of the components recorded in the transponders can be retrieved at any time and can be used to assess the state of wear.

In particular, the operating data relevant to the exchangeable component can be transferred automatically to the transponder for recording in the event of a work interruption. This may be the case, for example, on the initiation of a bobbin change, or a batch change or when there is a yarn break or a clearer cut or after the textile machine has been switched on. This achieves gap-free recording of the operating data over the lifecycle of the exchangeable components.

Advantageously, the operating data stored in the transponder may be automatically read out on introduction of the components into the workstations of the textile machine. Thus, the servicing personnel have available the data of the respective components which are installed in the textile machine as a replacement for other components. The data may be displayed for this purpose, for example directly at the respective workstation or at a central control unit.

Alternatively, the operating data stored in the transponders of the exchangeable components may be read out independently of their use in the workstations of the textile machine. This is, in particular, advantageous when storing the exchangeable components as the operating data recorded in the transponders can be retrieved at any time in order to be able to categorise the components according to their state of wear or to already be able to select them prior to their installation in the workstation of the textile machine.

For this purpose, the transponder may be read out and written by means of a transceiver. Furthermore, the operating data stored in the transponder may be encoded. In this manner, undesired reading or over-writing of the operating data stored in the transponders may be prevented.

According to the improved textile machine of the present invention, it is proposed that a sensor device for writing and reading the transponders attached to the components or integrated into the components should be arranged in the region of each workstation. In this manner, the operating data already recorded on the transponder are read out when the components are introduced into the respective workstation of the textile machine or the operating data are updated in the already installed position of the components after each completed work cycle to continuously document the lifecycle of the components. When the components are put into operation for the first time, these are initialised, in other words, the time of putting into operation is stored on the transponder of the components.

Advantageously, the workstations may in each case have a control device which is connected to the transceivers. Furthermore, the textile machine may have a central unit which is connected to the transceivers. Thus, the operating data are transmitted by the superordinate central control unit or by the workstations' own control devices to the transceivers and vice versa. For this purpose, the transmission of the operating data may be initiated, for example, by work interruptions, which are communicated by the respective control device of the workstations or the central control unit to the transceivers. In addition, at regular time intervals, a communication of the operating data may be initiated to update the database on the transponders of the exchangeable components used in the textile machine.

The transponder may be both an active and a passive transponder. The use of an active or passive transponder depends inter alia on the service life to be expected of the component and on the required transmission range of the operating data stored on the transponder. Active transponders are equipped with their own energy supply and therefore have a higher range than passive transponders. On the other hand, passive transponders are more economical.

The transceivers are preferably configured in such a way that the operating data of a plurality of components can be read out simultaneously. This is, in particular, advantageous if, for example, an assessment of components in stock is to be carried out as this process can be considerably accelerated thereby.

BRIEF DESCRIPTION OF THE DRAWINGS

Further details of the invention can be inferred below from an embodiment shown in the drawings, in which.

DETAILED DESCRIPTION OF THE PREFERRED EMBODIMENTS

Figure 1:
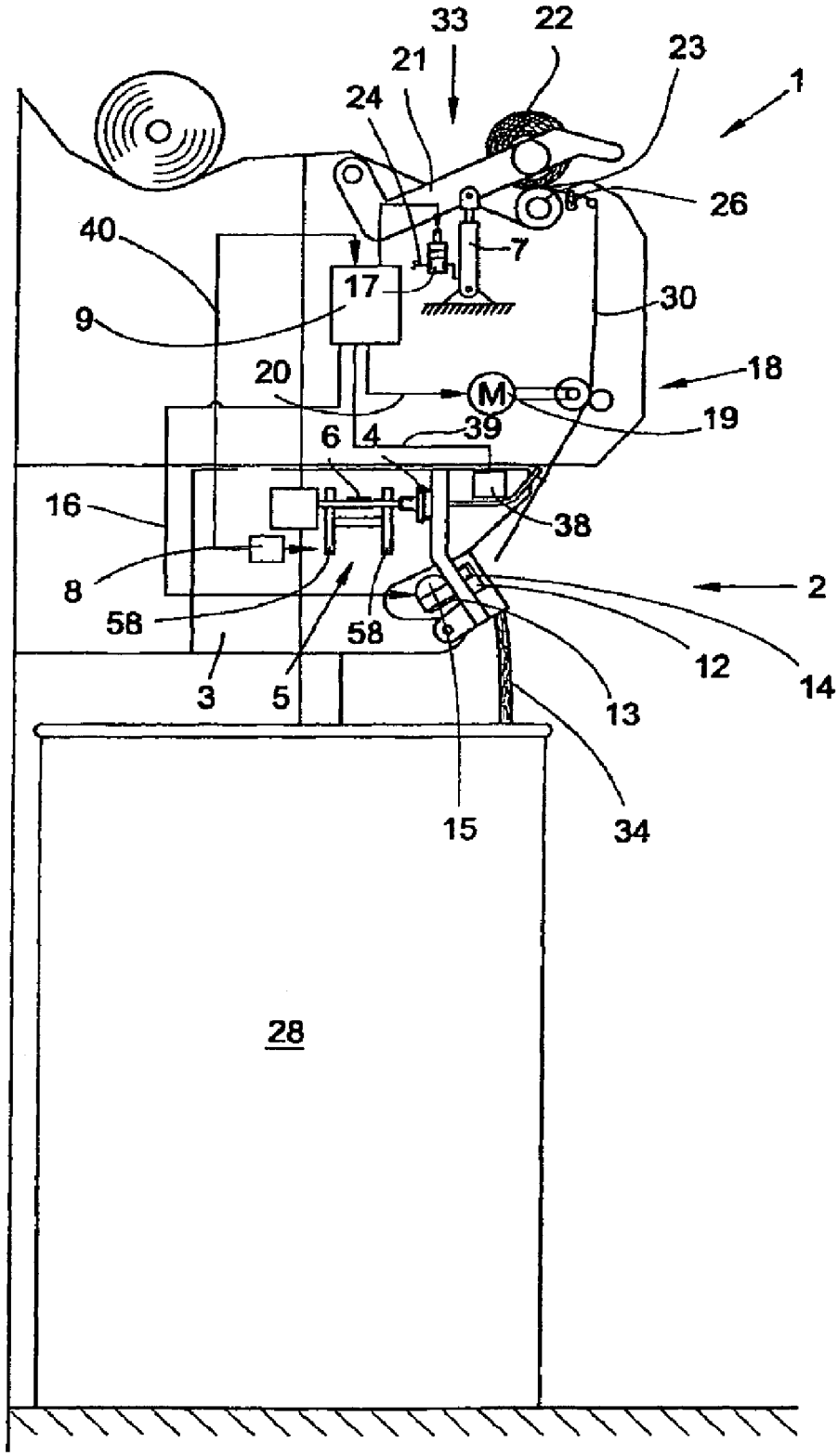
FIG. 1 shows a side view of a workstation of an open-end rotor spinning machine.

FIG. 1 shows one half, i.e., one side, of a semi-automatic open-end rotor spinning machine 1. Such spinning machines have a plurality of workstations 2, which are in each case equipped with a spinning mechanism 3 and a winding device 33. In the spinning mechanisms 3, the fiber band 34 fed in spinning cans 28 is spun in each case to form a yarn 30 which is wound on the winding device 33 to form a cross-wound bobbin 22. The winding devices 33 in this case have, as known per se, a respective creel 21 for the rotatable holding of the tube of a cross-wound bobbin 22, a winding drive roller 23, a yarn traversing device 26 and a device 7 for lifting the cross-wound bobbin 22 from the bobbin drive roller 23.

The device 7 is, for example, configured as a thrust piston gear which is connected via a pneumatic line 24, into which an electromagnetic valve 17 is connected, to an excess pressure source (not shown).

In the present embodiment, the drive of the bobbin drive roller 23 is implemented as a group drive. In other words, a drive shaft along the length of the machine is provided, to which the individual bobbin drive rollers 23 are fixed. In an alternative embodiment, however, a single motor drive of the bobbin drive roller 23 is also possible. In a case such as this, the drive of the bobbin drive roller 23 is connected by a corresponding control line to the spinning station's own control device 9.

In the region of the winding device 33, a yarn lifting device (not shown), known per se, may also be installed. A yarn lifting device of this type prevents the yarn unintentionally being able to be captured during the piecing process by the traversing yarn traversing device 26. In other words, the yarn lifting device configured, for example, as a foldable plate firstly holds the yarn 30 during the actual piecing process at a spacing above the yarn traversing device 26 moving back and forth.

The spinning mechanism 3 substantially, as known, has a spinning rotor 4, a fiber band opening roller 12 and a fiber band draw-in cylinder 14.

According to the embodiment of FIG. 1, the spinning rotor 4 is, for example, mounted in a support disc bearing 5 and is driven by a tangential belt 6 along the length of the machine.

To record the rotational speed of the spinning rotor 4, a sensor device 8 may also be provided which is then connected via a signal line 40 to the control device 9. The fiber band opening roller 12 is preferably also acted upon via a tangential belt 13 along the length of the machine, while the fiber band draw-in cylinder 14 is driven by a single motor via a drive 15.

The drive of the fiber band draw-in cylinder 14, for example a stepping motor 15 is also connected to the control device 9 via a control line 16. Furthermore, the workstations 2 in each case have a yarn draw-off device 18, the drive 19 of which is connected to the control device 9 via a control line 20.

Figure 3:
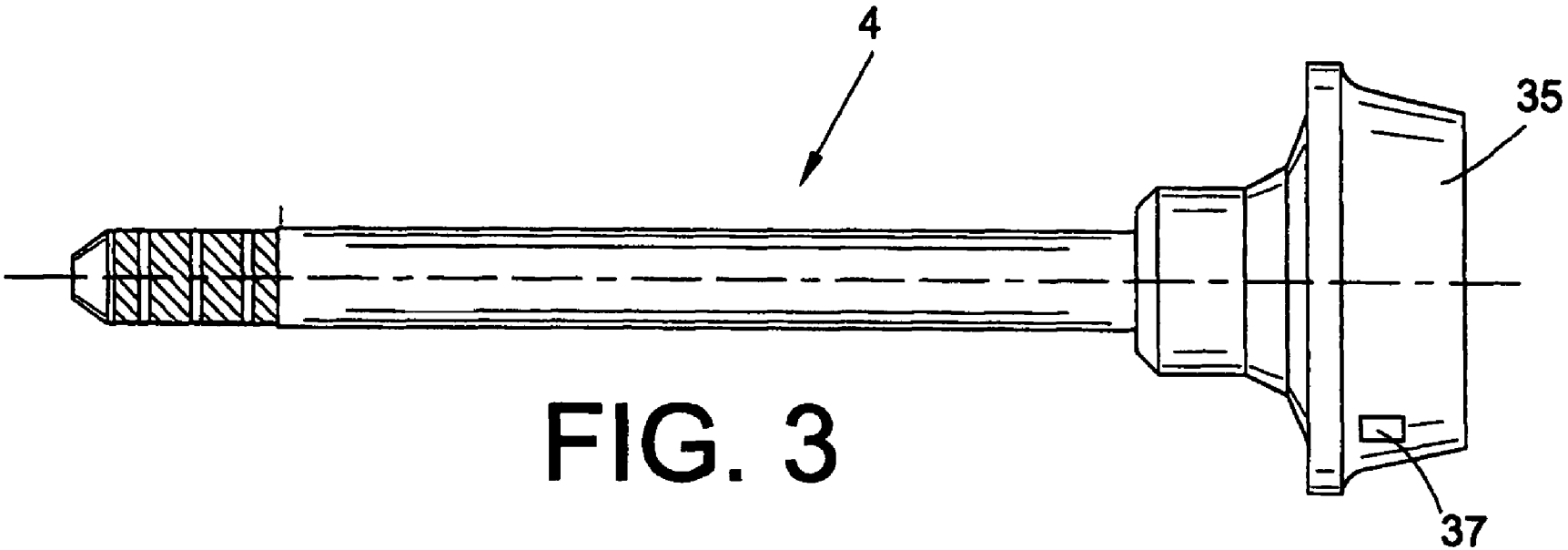
FIG. 3 shows a schematic view of a spinning rotor.

Arranged in the region of the workstation 2 is a transceiver 38, which allows the contactless reading out and writing of transponders 37 which are arranged on the exchangeable components of the workstation 2 or are integrated in them, as shown in FIG. 3 with the aid of the spinning rotor 4. The transceiver 38 is connected to the spinning station's own control device 9 via a control line 39.

Figure 2:
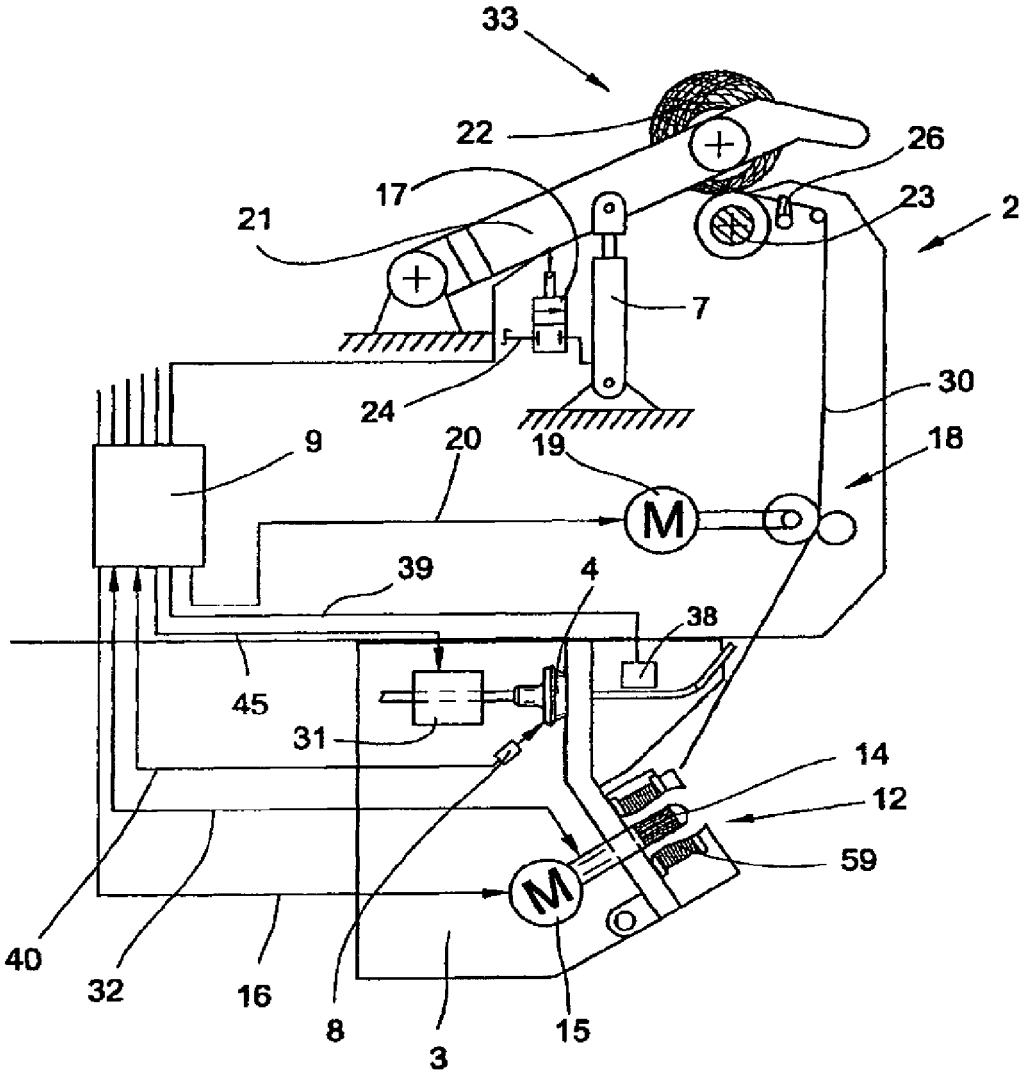
FIG. 2 schematically shows the activation of the individual drives of a workstation in a further embodiment of the open-end rotor spinning machine.

In an alternative embodiment, which is shown in FIG. 2, the spinning rotor 4 is not supported in a support disc bearing 5, but in a magnetic bearing indicated only schematically. The spinning rotor 4 is preferably acted upon in a case such as this by a single drive 31.

The spinning rotor drive 31 is in this case connected to the control device 9 via a control line 45. As further shown in the embodiment according to FIG. 2, the fiber band opening roller 12 may also be driven by a single motor. In other words arranged inside the clothing ring of the fiber band opening roller 12 is, for example, an external rotor drive 59 which is also connected to the control device 9 via a control line 32.

An exchangeable component of the workstation 2, the spinning rotor 4 can be inferred from the view of FIG. 3. The spinning rotor 4 is provided on the outside of the spinning cup 35 with a passive transponder 37. Alternatively, active transponders can also be used; in other words, the transponders have their own current supply mechanism. This influences the range within which the data can be received and transmitted by the transponder.

Figure 4:
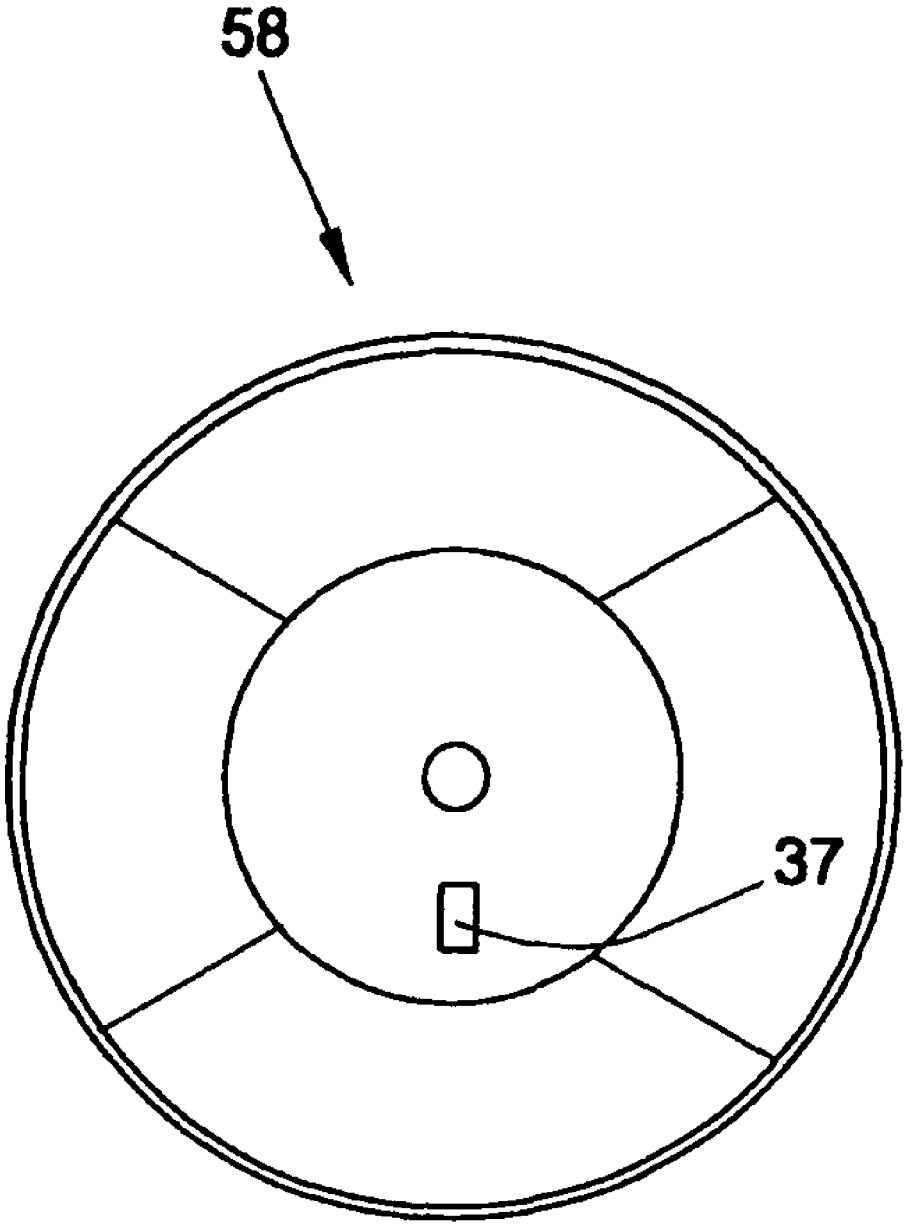
FIG. 4 shows a schematic view of a support disc.
Figure 5:
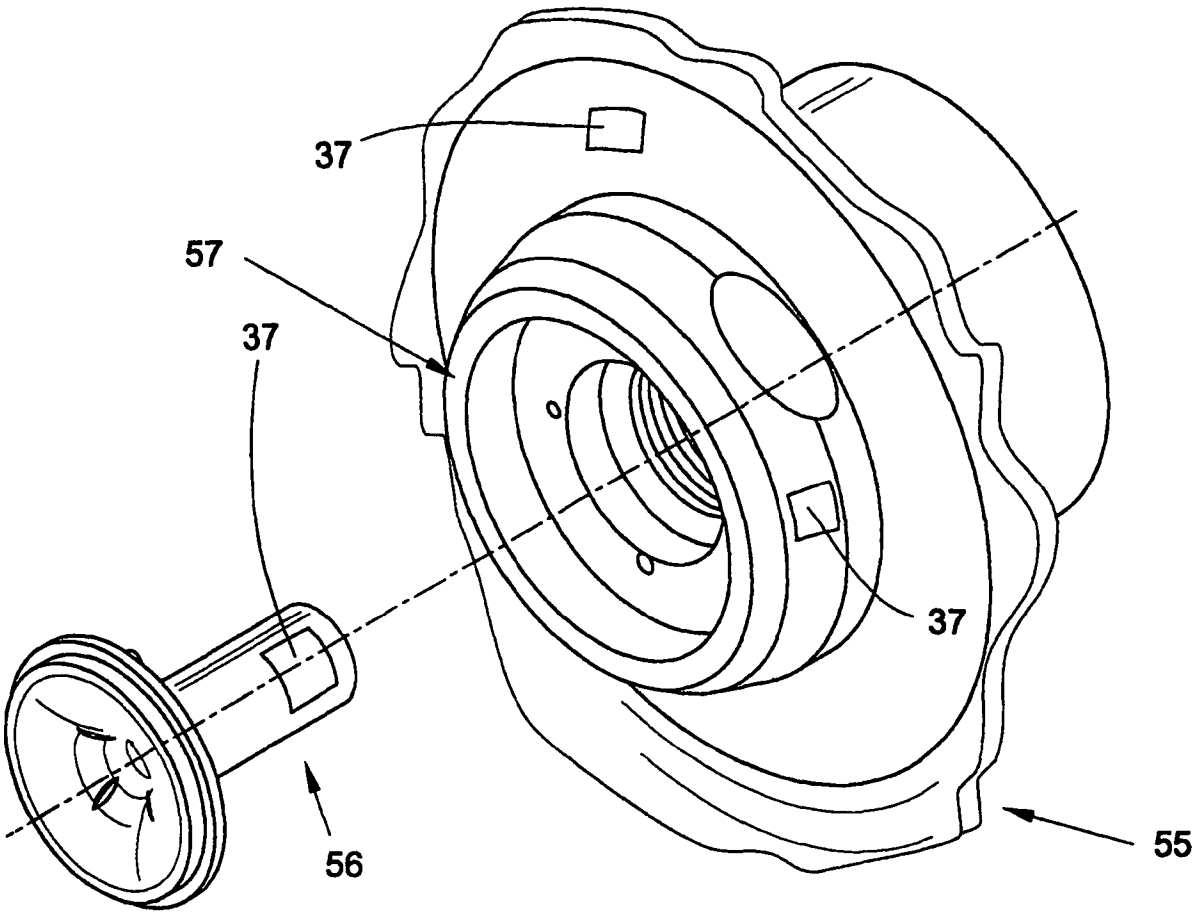
FIG. 5 shows a perspective view of a draw-off nozzle and a channel plate and a channel plate adapter.

FIGS. 4 and 5 show further exchangeable components of an open-end rotor spinning machine, such as a support disc 58, a draw-off nozzle 56, a channel plate 55 and a channel plate adapter 56 which are in each case equipped with a transponder 37 for recording operating data.

The method according to the invention is described in more detail with the aid of the exchange of the spinning rotor 4. If a new, previously unused spinning rotor 4 is used in a workstation 2, the transponder 37 arranged on the spinning rotor cup 35 is detected upon supply to the workstation 2 by the transceiver 38, which leads to an activation of the transponder 37. The operating data stored at this time in the transponder 37 are read out and passed to the control device 9. The operating data are details about the previous period of use, use conditions such as rotor speed, throughput, number of yarn breaks and the like, in particular operating data which are suitable to characterise the behaviour of the spinning rotor as a function of the degree of wear.

Since, as already mentioned this involves an unused spinning rotor 4, the lifecycle of which begins with its first use in the workstation 2, first of all the time at which the spinning rotor 4 is first put into operation is stored on the transponder 37. The operating data required for this are passed from the control device 9 to the transceiver 38 of the relevant workstation 2. All the operating data which directly relate to the spinning rotor 4 and determine its wear behaviour, are now recorded when the spinning rotor is put into operation. The providing of these operating data likewise takes place by means of the control device 9. The operating data to be recorded are for example batch data, in particular the fiber material use and the quantity of fiber band processed which was supplied to the spinning rotor 4 during its use on this open-end rotor spinning machine 1. Thus, at any time, the throughput of the batch processed last or the total throughput of the spinning rotor 4 can be determined.

Furthermore, for example, the rotational speeds of the spinning rotor 4 recorded by the sensor device 8 or the rotational speed adjusted at the control device 9 are passed to the transceiver 38 and transmitted to the transponder 37. Furthermore, the number of yarn breaks at the workstation 2 is recorded and transmitted to the transponder 37.

This flow of information is maintained over the entire residence time of the spinning rotor 4 in the workstation 2. In the process, the operating data to be recorded are constantly updated on the occurrence of a work interruption, for example at the beginning of a bobbin change to ensure gap-free recording of the operating data of the spinning rotor 4.

When a change of the spinning rotor 4 is required, for example because of a batch change, the operating data stored in the transponder 37 are retained. If at a later point in time, the same spinning rotor 4 is installed in another open-end rotor spinning machine, the operating data of the spinning rotor 4 recorded and stored over the previous lifecycle are read out as already written at this textile machine and are available for evaluation of the state of wear independently of the previous use of the spinning rotor 4.

For this purpose, the operating data stored in the transponders 37 of the exchangeable components can be read out independently of their use in the workstations 2 of the textile machine 1. Reading out can take place by means of a hand device or the like so as to be able to categorise components to be exchanged before their use in the workstations 2.

The method according to the invention can also be correspondingly used, for example, for the fiber band opening roller 12, the support disc 58, the draw-off nozzle 56, the channel plate 55 or the channel plate adapter 57 of the open-end rotor spinning machine.

What is claimed is:

1. Method for operating a textile machine (1) having a plurality of workstations (2), wherein the workstations (2) comprise exchangeable components, which in each case have a readable and writable transponder (37) which is arranged on the exchangeable components or integrated therein, characterised in that during the lifecycle of the exchangeable components at least the operating data which influence the state of wear of the exchangeable components and can be recorded for these during the period of use thereof are automatically stored on the respective transponder (37).

2. Method according to claim 1, characterised in that the operating data of the exchangeable components which are directly connected with the material to be processed are recorded.

3. Method according to claim 1, characterised in that the operating data recorded in the transponder (37) are not deleted when the exchangeable components are removed from the textile machine (1).

4. Method according to claim 1, characterised in that the operating data relevant to the exchangeable components are transmitted after each completed work process to the transponder (37).

5. Method according to claim 1, characterised in that the operating data stored in the transponder (37) are automatically read out when an exchangeable component is connected to the textile machine (1).

6. Method according to claim 1, characterised in that the operating data stored in the transponders (37) of the exchangeable components are read out independently of their use in the workstations (2) of the textile machine (1).

7. Method according to claim 1, characterised in that the transponder (37) is read out and written by means of a transceiver (38).

8. Method according to claim 1, characterised in that the operating data stored in the transponders (37) are encoded.

9. Textile machine (1) having a plurality of workstations (2), wherein the workstations (2) comprise exchangeable components, which in each case have a readable and writable transponder (37) which is arranged on the exchangeable components or integrated therein, characterised in that each respective transponder includes an arrangement which records and automatically stores at least the operating data occurring during the operating lifecycle of the exchangeable components which influence the state of wear of the exchangeable components, and at least one transceiver (38) which reads and writes the operating data to the transponders (37) is arranged in the region of each workstation (2).

10. Textile machine (1) according to claim 9, characterised in that the workstations (2) have a control device (9) in each case, which is connected to the transceivers (38) of the respective workstation (2).

11. Textile machine (1) according to claim 9, characterised in that the textile machine (1) has a central control unit which is connected to the transceiver (38).

12. Textile machine (1) according to claim 9, characterised in that the transceivers (38) are configured in such a way that the operating data of a plurality of exchangeable components can be read out simultaneously.

13. Textile machine (1) according to claim 9, characterised in that the exchangeable component is a rotor cup (35) which has a transponder (37).

14. Textile machine (1) according to claim 9, characterised in that the exchangeable component is an opening roller (12) which has a transponder (37).

15. Textile machine (1) according to claim 9, characterised in that the exchangeable component is a draw-off nozzle (56) which has a transponder (37).

16. Textile machine (1) according to claim 9, characterised in that the exchangeable component is a support disc (58) which has a transponder (37).

17. Textile machine (1) according to claim 9, characterised in that the exchangeable component is a channel plate (55) which has a transponder (37).

18. Textile machine (1) according to claim 9, characterised in that the exchangeable component is a channel plate adapter (57) which has a transponder (37).

* * * * *